US006127022A

United States Patent [19]

Pretorius

[11] Patent Number: 6,127,022

[45] Date of Patent: Oct. 3, 2000

[54] DECEPTION METHOD AND PRODUCT

[75] Inventor: Zagarias Hendrik Johannes Pretorius, Pretoria, South Africa

[73] Assignee: Finstruct (Proprietary) Limited, Preotoria, South Africa

[21] Appl. No.: 09/202,778

[22] PCT Filed: Jun. 18, 1997

[86] PCT No.: PCT/GB97/01645

§ 371 Date: Dec. 21, 1998

§ 102(e) Date: Dec. 21, 1998

[87] PCT Pub. No.: WO97/48964

PCT Pub. Date: Dec. 24, 1997

[30] Foreign Application Priority Data

Jun. 20, 1996 [ZA] South Africa ..... 96/5240

[51] Int. Cl.[7] ..... B32B 3/00

[52] U.S. Cl. ..... 428/195; 428/17; 428/207; 428/212; 428/919; 8/478

[58] Field of Search ..... 428/919, 17, 212, 428/15, 195, 207; 2/900; 156/61; 8/478

[56] References Cited

U.S. PATENT DOCUMENTS

| | | | |
|---|---|---|---|
| 1,817,871 | 8/1931 | Brandt . | |
| 3,700,397 | 10/1972 | Ramsley et al. | 8/4 |
| 3,748,471 | 7/1973 | Ross et al. | 250/333 |
| 4,095,940 | 6/1978 | Weingarten | 8/15 |
| 4,494,245 | 1/1985 | Burkhead et al. | 2/2 |
| 4,495,239 | 1/1985 | Pusch et al. | 428/192 |
| 4,528,229 | 7/1985 | Gottlieb | 428/85 |
| 4,529,633 | 7/1985 | Karlsson | 428/17 |
| 4,576,904 | 3/1986 | Anitole | 430/347 |
| 4,640,851 | 2/1987 | Pusch | 428/17 |
| 4,656,065 | 4/1987 | Yacovella | 428/17 |
| 4,659,602 | 4/1987 | Birch | 428/88 |
| 4,865,900 | 9/1989 | Shannon et al. | 428/195 |
| 4,868,019 | 9/1989 | Knickerbocker | 428/17 |
| 5,036,211 | 7/1991 | Scott | 250/495.1 |
| 5,043,202 | 8/1991 | Knickerbocker | 428/195 |
| 5,077,101 | 12/1991 | Conway et al. | 428/17 |
| 5,079,048 | 1/1992 | Anitole | 428/17 |
| 5,134,025 | 7/1992 | Zenda et al. | 428/317.9 |
| 5,159,718 | 11/1992 | Moyer | 2/69 |
| 5,281,460 | 1/1994 | Cox | 428/112 |
| 5,347,659 | 9/1994 | Tibljas | 2/84 |
| 5,409,760 | 4/1995 | Neitz et al. | 428/195 |
| 5,541,735 | 7/1996 | Rengle | 356/402 |

FOREIGN PATENT DOCUMENTS

| | | |
|---|---|---|
| 05-060496 | 3/1993 | Japan . |
| 841267 | 7/1960 | United Kingdom . |
| 9419659 | 9/1994 | WIPO . |

OTHER PUBLICATIONS

Patent Abstracts of Japan, vol. 017, No. 377 dated Mar. 9, 1993.

Derwent Abstract of JP 05060496 Dated Mar. 9, 1993.

English Translation of JP05060496.

*Primary Examiner*—Deborah Jones
*Assistant Examiner*—Wendy Boss
*Attorney, Agent, or Firm*—Ladas & Parry

[57] ABSTRACT

A camouflage surface for concealment from, and deception of, a herbivorous animal comprises a camouflage pattern made up of at least two different types of regions which reflect electromagnetic radiation in the near-infra-red range of the electromagnetic spectrum. All the regions of each type reflect the near-infra-red radiation in the same fashion as one another and in a fashion different from the fashion in which the regions of each other type reflect the radiation. The different types of regions all have, in the near-infra-red range, spectral reflectance curves having reflectance maxima at wavelengths of at least 680 nm. Each spectral reflectance curve which the surface has in the visible light range of the electromagnetic spectrum is without a reflectance maximum in the wavelength range between 480 and 680 nm and each spectral reflectance curve which the surface has in the visible light range has a reflectance maximum at a wavelength of at most 480 nm.

16 Claims, 1 Drawing Sheet

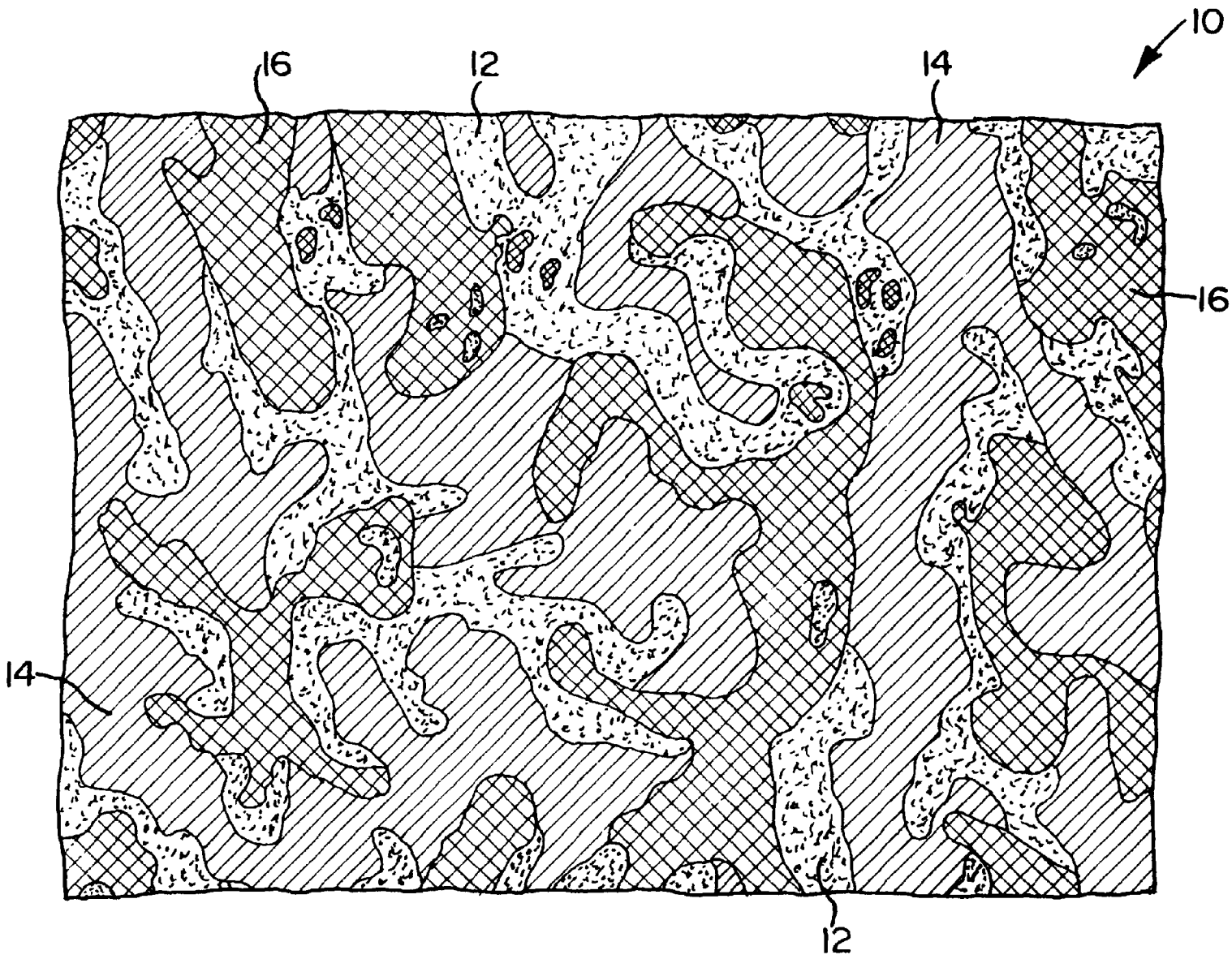
10
16
14
12
12
16
14

DECEPTION METHOD AND PRODUCT

THIS INVENTION relates to vision deception. More particularly, the invention relates to vision deception by means of camouflage, the invention providing a camouflage surface and a method of camouflaging, suitable for camouflaging a person, such as a hunter, or such person's vehicle from herbivorous prey being hunted, and a camouflage pattern suitable for use, in accordance with the method on such vehicle, hunter's clothing, or the like.

By the term camouflaging, as used herein, is meant the technique whereby a pattern made up of two or more colours, ie two or more hues or two or more nuances of the same hue but having different reflectances, typically three, which contrast with each other or with one another, is used to deceive the eye of an observer by promoting concealment of a person or object to be camouflaged, by encouraging the eye of the observer to follow hues forming part of the pattern, rather than to follow the outline of the person or object, or the outlines of parts thereof, which outline or outlines act as visual cues for the optical recognition of the person or object by the observer. Different hues have spectral reflectance curves of different shapes, while different nuances of the same hue have spectral reflectance curves of the same shape but of different reflectances.

Camouflaging is often employed for military concealment or deception purposes, eg to camouflage persons via their clothing or uniforms, or to camouflage vehicles, tents or the like. The shapes and/or outlines of suitable camouflage patterns for military use have been well established for military purposes, being made up of contrasting areas in the form of strips, patches or other zones of contrasting colours, of more or less irregular- and non-repeating outlines, which outlines are usually curved. The colours, such as khaki or olive-green drab are selected, as are the patterns, to blend in, to a human observer, with the colours and shapes prevalent in the background against which the camouflage is expected to be viewed. Generally, account is taken of the distance at which the camouflage is expected to be seen, the areas forming the pattern being relatively smaller if the camouflage is expected to be seen from shorter distances, and relatively larger if the camouflage is expected to be seen from longer distances, so that the areas can be distinguished from each other or one another. Furthermore the areas must be sufficiently small, relative to the total camouflaged surface, for the repeating nature of the pattern to be apparent, and for the outlines of the areas of the pattern, between contrasting areas thereof, to be able to compete successfully with the outline of the camouflaged surface i.e. camouflaged person or object or part thereof, for the attention of the eye.

In accordance with one aspect of the invention there is provided a camouflage surface for concealment from, and deception of, a herbivorous animal, which surface comprises a camouflage pattern made up of at least two different sets of areas which reflect electromagnetic radiation at wavelengths in the near-infra-red range or zone of the electromagnetic spectrum, all the areas of each set reflecting said near-infra-red radiation in the same fashion as one another and in a fashion different from the fashion in which the areas of each other set reflect said radiation, the different sets of areas all having, in said near-infra-red range, spectral reflection curves having reflectance maxima at wavelengths of above 680 nm, each spectral reflectance curve which the surface has in the visible light range of the electromagnetic spectrum being without a reflectance maximum in the wavelength range of 480–680 nm and each said spectral reflectance curve which the surface has in said visible light range having a reflectance maximum at a wavelength below 480 nm.

The pattern will not be apparent to the human eye, which cannot see in the near-infra-red range of the electromagnetic spectrum, but will be apparent to the eye of a herbivore, particularly a mammalian herbivore such as a buck, deer or antelope, whose eye is well evolved to see and perceive colours in the near infra-red range of the electromagnetic spectrum. To make the pattern more clearly apparent, said colours preferably have different reflectances. If desired, there may be both different hues in the pattern, and different reflectances or nuances.

The number of said sets of areas may be selected from two sets of areas, three sets of areas and four sets of areas. The different sets of areas may all have spectral reflectance curves of the same shape in the wavelength range of 680–900 nm, all said curves having reflectance maxima at the same wavelength in said wavelength range of 680–900 nm, the maxima having different values.

Instead, the different sets of areas may all have spectral reflection curves of different shapes in the wavelength range of 680–900 nm, all the areas of each set having spectral reflectance curves of the same shape, which shape is different from the shape of the spectral reflectance curves of the areas of each other set of areas, all said curves having reflectance maxima in said wavelength range of 680–900 nm, and the reflectance maximum of each curve being at a wavelength different from the wavelength of the reflectance maximum of each other curve.

In each case there may be two said sets of areas, one of said sets of areas having a spectral reflectance curve having a reflectance maximum of 50–75%, and the other of said sets of areas having a spectral reflectance curve having a reflectance maximum of 5–25%. Instead, there may be three said sets of areas, one of said sets of areas having a spectral reflectance curve having a reflectance maximum of 50–75%, another of said sets of areas having a spectral reflectance curve having a reflectance maximum of 5–25%, and the other of said sets of areas having a spectral reflectance curve having a reflectance maximum of 25–50%.

More particularly, all of said spectral reflectance curves have reflectance maxima which are in the wavelength range 680–900 nm.

In addition to said camouflage pattern, the surface may comprise, thereon, a pseudo-camouflage pattern made up of at least two different sets of areas, which areas, in the visible light zone of the electromagnetic spectrum, all have spectral reflectance curves having spectral reflectance maxima at wavelengths below 480 nm. As with the camouflage pattern, the number of sets of areas of the pseudo-camouflage pattern may be selected from two sets of areas, three sets of areas and four sets of areas.

The different sets of areas of the pseudo-camouflage pattern may all have spectral reflectance curves of the same shape in the wavelength range of 440–480 nm, all said curves having reflectance maxima at the same wavelength in the wavelength range of 440–480 nm, the maxima having different values. Instead, the different sets of areas of the pseudo-camouflage pattern may all have spectral reflectance curves of different shapes in the wavelength range of 440–480 nm, all the areas of each set having spectral reflectance curves of the same shape, which shape is different from the shape of the spectral reflectance curves of the areas of each other set of areas, all said curves having reflectance maxima in said wavelength range of 440–480 nm and the reflectance maximum of each curve being at a wavelength different from the wavelength of the reflectance maximum of each other curve. In each case, whether two or three or more sets of areas are used, the reflectance maxima may be in the wavelength range of 440–480 nm. Conveniently, the pseudo-camouflage pattern has the same number of sets of areas as the number of sets of areas of the camouflage pattern. Thus, the pseudo-camouflage pattern and the camouflage pattern may be the same pattern, the sets of areas of the pseudo-camouflage pattern comprising areas which have outlines which coincide respectively with the outlines of the areas of the sets of areas of the camouflage pattern.

The surface may be for concealing a human outline from a herbivore, the surface being of flexible material for the manufacture of clothing and the constituent areas of each pattern being sufficiently large for the areas of each set of areas of that pattern, when contrastingly coloured with colours in the visible light zone of the electromagnetic spectrum from the areas of each other set of areas making up the pattern, to be visually distinguishable to a human observer at a distance of 100 m from the areas of each other set of areas making up that pattern, said areas being sufficiently small for a portion of the material having the size and shape of said human outline to contain at least some of the areas of each set. Instead, the surface may be for concealing a vehicle outline from a herbivore, the surface being provided by at least part of the outer surface of the vehicle and the constituent areas of each pattern being sufficiently large for the areas of each set of areas of that pattern, when contrastingly coloured with colours in the visible light zone of the electromagnetic spectrum from the areas of each other set of areas making up the pattern, to be visually distinguishable to a human observer at a distance of 100 m, said areas being sufficiently small for the camouflaged part of the vehicle surface to contain at least some of the areas of each set.

As indicated above, the colours employed for the camouflage pattern will each have a reflectance maximum at a wavelength of above 680 nanometers (nm), preferably in the wavelength range of 680–900 nm, suitable for creating a substantial eye response in the herbivore in question. Typically, as with military camouflage,the camouflage pattern will have three types of contrasting areas, which can contrast with one another by being of different hues, and/or by being of different nuances, ie different reflectances, of the same hue. They may thus be distinguishable by reflecting at different wavelengths and/or by reflecting at the same wavelengths but at different reflectances.

Patterns whose areas have shapes or outlines known in the art for military purposes can be used for the present invention, and, for a hunter's clothing, a pattern may be selected which is suitable for concealing the human outline of the wearer at a distance of 80–120 meters, eg 100, meters. For hunting vehicles a larger pattern may be selected, suitable for concealment of such vehicles at longer distances.

Whether the camouflage pattern is of contrasting areas of different, more or less closely spaced, hues, or is of different nuances (reflectances) of the same hue, it is desirable for the respective reflectances of the contrasting areas to be selected, not only to form the contrasting pattern of the camouflage, but to blend in with the background against which the camouflage is expected to be seen. Typically, the areas of the highest reflectance of the pattern can be provided with a value which corresponds with the reflectance of the parts of the background of highest reflectance, the areas of lowest reflectance of the pattern can be provided with a value which corresponds with the reflectance of the parts of the background of lowest reflectance, and, if there is a third set of areas, this can be provided with a value intermediate, eg midway between, the values of the areas of highest reflectance and those of lowest reflectance. The Applicant has found that, for concealment from a herbivore against a background characterized by chlorophyll in leaves, a pattern, as indicated above, having maximum reflectance areas of 65–75% reflectance and minimum reflectance areas of 15–25% reflectance is suitable, any intermediate reflectance areas which may be employed having 40–50% reflectance. Thus, an example is a pattern with maximum reflectance areas of 70% reflectance, minimum reflectance areas of 20% reflectance, and intermediate reflectance areas of 45% reflectance, all optionally being of the same hue and of different nuances, or of different hues, in the near-infra-red range of the spectrum, in so far the near-infra-red range of the spectrum can be regarded as having, by analogy with the visible range or zone of the spectrum, hues or nuances.

In accordance with a further important feature of the invention, the camouflaged surface, in addition to being provided with a camouflage pattern visible to a herbivore in the near infra-red range of the electromagnetic spectrum, is also, as indicated above, provided with one or more preferably vivid colours having a wavelength in what is the visible spectrum to the human eye, but outside the wavelength which is visible to the herbivore. Each such vivid colour may be in the blue range of the visible spectrum, at a wavelength of less than 480 nm, eg 440–480 nm. The intention of this vivid colour is to make a camouflage surface, such as that of a vehicle or a person wearing camouflaged clothing, in accordance with the invention, clearly visible to human observers, such as hunters.

It follows that the camouflage surface may contain a plurality of pigments, at least one being clearly and preferably vividly visible to humans but essentially invisible to herbivores and reflecting predominantly at one or more wavelengths of less than 480 nm but poorly, if at all, at wavelengths of 680–900 nm, and at least two reflecting predominantly at one or more wavelengths of above 680 nm, but poorly, if at all, at wavelengths of less than 480 nm. The camouflage surface will thus comprise a pigment or pigments visible to the human eye but less visible, preferably substantially less visible, to herbivores and will comprise at least two pigments which are contrasting to the herbivores, by virtue of their comprising a pigment or pigments each having substantial reflectance at wavelengths in the near-infra-red range of the electromagnetic spectrum, the pigments reflecting in the near-infra-red range preferably displaying different reflectances.

It is expected, however, that, although a single colour and single reflectance will be adequate and indeed desirable for high visibility in the spectrum visible to the human eye at wavelengths below 480 nm, users will, for marketing/consumer/psychological reasons, prefer to see or have a perception of a camouflaged surface in accordance with the invention which appears, in the spectrum visible to the human eye at wavelengths below 480 nm, to the human eye, also to camouflaged. Thus, for customer acceptance, a bogus- or pseudo-camouflage pattern may, as indicated above, be provided on the camouflage surface in the spectrum visible to the human eye. As this pseudo-camouflage pattern is intended merely to reassure the user that the surface is indeed camouflaged, and as it is, in hunting situations, undesirable to camouflage the surface from a human observer, a pattern in the visible spectrum below 480 nm may be selected which is indeed ineffective for camouflaging at the intended distance at which the surface is to be seen, eg by having contrasting areas too small to be effective at, say, 80–120 m, and/or by having a contrast which is insufficient, so that, while the bogus pattern is visible to a human at close range, it is more or less invisible to the human eye at 80–120 m, so that it fails to camouflage the outline of the camouflage surface to a human observer at this distance.

The invention also provides a method of camouflaging, for concealment from, and deception of, a herbivorous animal, which method comprises providing, on a surface to be camouflaged, a camouflage pattern made up of at least two different sets of areas which reflect electromagnetic radiation at wavelengths in the near-infra-red range of the electromagnetic spectrum, all the areas of each set reflecting said near-infra-red radiation in the same fashion as one another and in a fashion different from the fashion in which the areas of each other set reflect said radiation, the different sets of areas all having, in said near-infra-red range, spectral reflectance curves having reflectance maxima at wavelengths of above 680 nm, each spectral reflectance curve which the surface has in the visible light range of the electromagnetic spectrum being without a reflectance maximum in the wavelength range of 480–680 nm and each said spectral reflectance curve which the surface has in said visible light range having a reflectance maximum at a wavelength below 480 nm.

The invention extends further to a camouflage pattern for concealment from, and deception of, a herbivorous animal, the pattern being made up of at least two different sets of areas which reflect electromagnetic radiation at wavelengths in the near-infra-red range of the electromagnetic spectrum, all the areas of each set reflecting said near-infra-red radiation in the same fashion as one another and in a fashion different from the fashion in which the areas of each other set reflect said radiation, the different sets of areas all having, in said near-infra-red range, spectral reflectance curves having reflectance maxima at wavelengths of above 680 nm, each spectral reflectance curve which the pattern has in the visible light range of the electromagnetic spectrum being without a reflectance maximum in the wavelength range of 480–680 nm and each said spectral reflectance curve which the pattern has in said visible light range having a reflectance maximum at a wavelength below 480 nm.

BRIEF DESCRIPTION OF THE DRAWING

The invention will now be described, by way of example, with reference to the accompanying drawing in which the single FIGURE shows, schematically, a camouflage pattern in accordance with the present invention on a camouflage surface according to the invention, suitable for a hunter's clothing for use in the hunting of herbivore such as an antelope In the drawing the camouflage pattern is shown on a reduced scale, being illustrated at a fraction of 25% of full size. The pattern is intended for a hunter's clothing, and is intended to be effective at a distance of about 100 m from a observer which is an antelope.

In the drawing, the pattern is designated by reference numeral 10 and the total surface of the pattern is made up of a plurality of areas divided into three sets, namely a set of areas 12 indicated by stippling, a set of areas 14 indicated by shading, and a set of areas 16 indicated by cross-hatching. These areas 12, 14 and 16 are defined and distinguished from one another by their containing, and being coloured by, pigments which reflect at the same wavelengths but at different reflectances in the wavelength range 680–900 nm in the near infra-red zone of the electromagnetic spectrum. Thus, while the areas 12, 14 and 16 all contain these pigments, so that they reflect light at said near infra-red wavelengths, they have different reflectances at said infra-red wavelengths. Thus, one of the sets of areas 12, 14, 16 has, at a wavelength of 800 nm, a reflectance in the range of 53–65%, another set having, at a wavelength of 800 nm, a reflectance in the range of 5–15%, and the third set having, at a wavelength of 800 nm, a reflectance in the range of 27–38%.

The pattern is of more or less conventional shape, as regards the outlines or shapes of the areas 12, 14 and 16, as has been shown by experience to be appropriate for military purposes, for camouflaged clothing intended to be effective at about 100 m distance from a human observer.

The entire camouflaged surface is also coloured by a blue pigment, namely light sky blue pigment for the areas 12, a dark sky blue pigment for the areas 14, and a low reflectance (almost black) very dark blue pigment for the areas 16. The light sky blue, dark sky blue and almost black in question have spectral reflectance curves, expressed in percentage reflectance, which conform with the data set forth in the following Tables, Tables 1–3:

TABLE 1

| | Light Sky Blue | | | | | | | | | |
|---|---|---|---|---|---|---|---|---|---|---|
| nm | 00 | 10 | 20 | 30 | 40 | 50 | 60 | 70 | 80 | 90 |
| 400 | 18.7 | 25.0 | 26.1 | 30.9 | 40.7 | 47.2 | 48.6 | 48.5 | 46.1 | 42.7 |
| 500 | 38.4 | 32.9 | 26.4 | 20.3 | 15.5 | 11.8 | 9.0 | 7.4 | 6.7 | 6.2 |
| 600 | 5.9 | 5.7 | 5.7 | 5.7 | 5.8 | 6.0 | 6.3 | 6.4 | 6.3 | 6.1 |
| 700 | 5.9 | 5.8 | 6.0 | 6.7 | 8.2 | 12.1 | 22.6 | 37.3 | 49.9 | 57.7 |
| 800 | 62.6 | | | | | | | | | |

TABLE 2

| | Dark Sky Blue | | | | | | | | | |
|---|---|---|---|---|---|---|---|---|---|---|
| nm | 00 | 10 | 20 | 30 | 40 | 50 | 60 | 70 | 80 | 90 |
| 400 | 8.4 | 10.9 | 12.0 | 14.0 | 17.4 | 20.0 | 19.3 | 17.2 | 14.0 | 11.2 |
| 500 | 9.0 | 7.4 | 6.2 | 5.8 | 5.6 | 5.2 | 4.8 | 4.5 | 4.4 | 4.3 |
| 600 | 4.3 | 4.3 | 4.3 | 4.3 | 4.3 | 4.3 | 4.3 | 4.3 | 4.3 | 4.3 |

TABLE 2-continued

| | Dark Sky Blue | | | | | | | | | |
|---|---|---|---|---|---|---|---|---|---|---|
| nm | 00 | 10 | 20 | 30 | 40 | 50 | 60 | 70 | 80 | 90 |
| 700 | 4.3 | 4.3 | 4.3 | 4.6 | 5.1 | 6.6 | 9.9 | 14.1 | 18.7 | 23.5 |
| 800 | 28.8 | | | | | | | | | |

TABLE 3

| | Black | | | | | | | | | |
|---|---|---|---|---|---|---|---|---|---|---|
| nm | 00 | 10 | 20 | 30 | 40 | 50 | 60 | 70 | 80 | 90 |
| 400 | 6.0 | 6.2 | 6.2 | 6.3 | 6.5 | 6.5 | 6.5 | 6.5 | 6.4 | 6.3 |
| 500 | 6.3 | 6.2 | 6.0 | 5.7 | 5.4 | 5.0 | 4.7 | 4.4 | 4.2 | 4.1 |
| 600 | 4.1 | 4.1 | 4.1 | 4.1 | 4.1 | 4.1 | 4.1 | 4.1 | 4.1 | 4.1 |
| 700 | 4.1 | 4.1 | 4.2 | 4.5 | 4.9 | 5.7 | 6.8 | 7.4 | 7.7 | 7.9 |
| 800 | 7.9 | | | | | | | | | |

With regard to the Tables, it will be appreciated that there can be some variation from batch to batch with regard to the pigments used; and, with use, wear and washing of the material, changes in the reflectance can take place.

The areas 12, 14 and 16 reflect visible light predominantly at wavelengths of 440–480 nm, so that the camouflaged surface as a whole is clearly visible against a green background constituted by foliage or leaves, to a human observer, while, at the same image, the camouflage pattern of areas 12, 14 and 16 reflecting with different reflectances at 680–900 nm, is selected to cause the pattern to blend into said foliage background, breaking up the human outline of the wearer of camouflaged clothing having said pattern, and making the wearer relatively difficult to see, with regard to an observer which is an antelope. In this regard, while, at the present stage of development of the invention, the wavelength of the reflectance maximum in the near-infra-red range is closer to 900 nm than to 680 nm, it is to be noted that the Applicant believes that it may be possible that it may be beneficial to move this maximum to a shorter wavelength, closer to 680 nm and indeed possibly closer to 680 nm than to 900 nm.

Functionally, the blue pseudo-camouflage pattern will have little, if any, camouflaging effect in the visible zone of the electromagnetic spectrum to a human observer at a distance of about 100 m, so that it does not detract from the clear visibility to a human observer of the person/camouflaged garment at that distance. It is, however, expected to generate more sales appeal than a flat patternless blue colour, as most users are not expected to understand the mechanism of the present invention, the blue pseudo-camouflage pattern giving the impression that it contributes to the camouflaging, more than would a flat, uniform non-contrasting blue colour, which uniform colour can give the impression of no camouflaging. It follows that the blue pattern need not necessarily correspond with the infra-red pattern of areas 12, 14 and 16, although, as in the example shown in the drawing, it conveniently does.

It is an advantage of the invention with reference to the drawing that, on the one hand, a method of camouflaging and a camouflage surface and pattern are provided, in accordance with the method, which are suitable for concealment of a hunter from an antelope and, on the other hand, the method, surface and pattern provided thereby are readily visible to human observers, such as other hunters, so that the danger of hunters' accidentally shooting one another is reduced.

With regard to the aforegoing description and with regard to the claims which follow, it should be noted that, in the claims the expression "types of regions" is equivalent in meaning to the expression "sets of areas" in the description, so that, in this context, "types" and "regions" in the claims are respectively equivalent in meaning to "sets" and "areas" in the description.

What is claimed is:

1. A camouflage surface for concealment from, and deception of, a herbivorous animal, which surface comprises a camouflage pattern constituted by a plurality if occurrences of at least two different types of regions which reflect electromagnetic radiation at wavelengths in the near-infra-red range of the electromagnetic spectrum, all the occurences of one type of region reflecting said near-infra-red radiation in the same fashion as one another and in a fashion different from the fashion in which the regions occurences of each other type of region reflect said near-infra-red radiation, the different types of regions all having, in said near-infra-red range, spectral reflectance curves having reflectance maxima at wavelengths of at least 680 nm, each spectral reflectance curve which the surface has in the visible light range of the electromagnetic spectrum being without a reflectance maximum in the wavelength range between 480 and 680 nm and each said spectral reflectance curve which the surface has in said visible light range having a reflectance maximum at a wavelength of at most 480 nm.

2. A surface as claimed in claim 1, in which the number of said types of regions is selected from the group consisting of two types of regions, three types of regions and four types of regions.

3. A surface as claimed in claim 1, in which the different types of regions all have spectral reflectance curves of the same shape in the wavelength range of 680 –900 nm, all said curves of the same shape in said wavelength range of 680–900 nm having reflectance maxima at the same wavelength in said wavelength range of 680–900 nm, the maxima having different values.

4. A surface as claimed in claim 1, in which the different types of regions all have spectral reflectance curves of different shapes in the wavelength range of 680–900 nm, all the occurences of one type of region having spectral reflectance curves of the same shape in said wavelength range of 680–900 nm, which shape is different from the shape of the spectral reflectance curves of the occurences of each other type of region in said wavelength range of 680–900 nm, all said curves of different shapes having reflectance maxima in said wavelength range of 680–900 nm, and the reflectance maximum of each curve being at a wavelength different from the wavelength of the reflectance maximum of each said curve of a different shape.

5. A surface as claimed in claim 3, in which there are two said types of regions, one of said types of regions having a spectral reflectance curve having a reflectance maximum of 50–75%, and the other of said types of regions having a spectral reflectance curve having a reflectance maximum of 5–25%.

6. A surface as claimed in claim 3, in which there are three said types of regions, one of said types of regions having a spectral reflectance curve having a reflectance maximum of 50–75%, another of said types of regions having a spectral reflectance curve having a reflectance maximum of 5–25%, and the other of said types of regions having a spectral reflectance curve having a reflectance maximum of 25–50%.

7. A surface as claimed in claim 1, which comprises, thereon, a pseudo-camouflage pattern made up of a plurality of occurrences of at least two different types of regions, which regions, in the visible light range of the electromagnetic spectrum, all have spectral reflectance curves having spectral reflectance maxima at wavelengths of at most 480 nm.

8. A surface as claimed in claim 7, in which the number of types of regions of the pseudo-camouflage pattern is selected from the group consisting of two types of regions, three types of regions and four types of regions.

9. A surface as claimed in claim 7, in which the different types of regions of the pseudo-camouflage pattern all have spectral reflectance curves of the same shape in the wavelength range of 440–480 nm, all said curves of the same shape in said wavelength range of 440–480 nm having reflectance maxima at the same wavelength in the wavelength range of 440–480 nm, the maxima having different values.

10. A surface as claimed in claim 7, in which the different types of regions of the pseudo-camouflage pattern all have spectral reflectance curves of different shapes in the wavelength range of 440–480 nm, all the regions occurences of one type of region having spectral reflectance areas of the same shape in said wavelength range of 440–480 nm, which shape is different from the shape of the spectral reflectance curves of the occurences of each other type of region in said wavelength range of 440–480 nm, all said curves of different shapes having reflectance maxima in said wavelength range of 440–480 nm, and the reflectance maximum of each curve being at a wavelength different from the wavelength of the reflectance maximum of each said curve of a different shape.

11. A surface as claimed in claim 7, in which the pseudo-camouflage pattern has the same number of different types of regions as the number of types of regions of the camouflage pattern.

12. A surface as claimed in claim 11, in which the camouflage pattern and the pseudo-camouflage pattern are the same pattern, the regions of the pseudo-camouflage pattern having outlines which coincide respectively with the outlines of the regions of the camouflage pattern.

13. A surface as claimed in claim 1, the surface being of flexible material as for the manufacture of clothing and the constituent regions of the pattern being sufficiently large for the occurences of one type of region of that pattern, when contrastingly coloured with colours in the visible light range of the electromagnetic spectrum from the occurences of each other type of region making up the pattern, to be visually distinguishable to a human observers at a distance of 100 m, from the occurences of each other type of region making up that pattern, said regions being sufficiently small for a portion of the material having the size and shape of said human outline to contain at least some of the regions of each type.

14. A surface as claimed in claim 1, which is for concealing a vehicle outline from a herbivore, the surface being provided by at least part of the outer surface of the vehicle and the constituent regions of the pattern being sufficiently large for the occurences of one type of region of that pattern, when contrastingly coloured with colours in the visible light range of the electromagnetic spectrum from the occurences of each other type of region making up the pattern, to be visually distinguishable to a human observer, at a distance of 100 m, from the occurences of each other type of region making up that pattern, said regions being sufficiently small for the camouflaged part of the vehicle surface to contain at least some of the regions of each type.

15. A method of camouflaging, for concealment from, and deception of, a herbivorous animal, which method comprises providing, on a surface to be camouflaged, a camouflaged pattern constituted by a plurality of occurences of at least two different types of regions which reflect electromagnetic radiation at wavelengths in the near-infra-red range of the electromagnetic spectrum, all the occurences of one type of region reflecting said near-infra-red radiation in the same fashion as one another and in a fashion different from the fashion in which the occurences of each other type of region reflect said near-infra-red radiation,the different types of regions all having, in said near-infra-red range, spectral reflectance curves having reflectance maxima at wavelengths of at least 680 nm, each spectral reflectance curve which the surface has in the visible light range of the electromagnetic spectrum being without a reflectance maximum in the wavelength range between 480 and 680 nm and each said spectral reflectance curve which the surface has in said visible light range having a reflectance maximum at a wavelength of at most 480 nm.

16. A camouflage pattern for concealment from, and deception of, a herbivores animal, the pattern being constituted by a plurality of occurences of at least two different types of regions which reflect electromagnetic radiation at wavelengths in the near-infra-red range of the electromagnetic spectrum, all the occurences of one type of region reflecting said near-infra-red radiation in the same fashion as one another and in a fashion different from the fashion in which the occurrences of each other type of region reflect said near-infra-red radiation,the different types of regions all having, in said near-infra-red range, spectral reflectance curves having reflectance maxima at wavelengths of at least 680 nm, each spectral reflectance curve which the surface has in the visible light range of the electromagnetic spectrum being without a reflectance maximum in the wavelength range between 480 and 680 nm and each said spectral reflectance curve which the surface has in said visible light range having a reflectance maximum at a wavelength of at most 480 nm.

* * * * *

UNITED STATES PATENT AND TRADEMARK OFFICE

CERTIFICATE OF CORRECTION

PATENT NO. : 6,127,022

DATED : October 3, 2000

INVENTOR(S) : Zagarias Hendrik Johannes PRETORIUS

It is certified that error appears in the above-identified patent and that said Letters Patent is hereby corrected as shown below:

At column 8, line 37 (claim 1, line 3), "if" should read - - of - -.
At column 8, line 43 (claim 1, line 9), "regions" should be deleted.
At column 9, line 46 (claim 10, line 4), "regions" should be deleted.
At column 9, line 47 (claim 10, line 5), "areas" should read - - curves - -.
At column 10, line 9 (claim 13, line 11), "said" should read - - a - -.
At column 10, line 29 (claim 15, line 4), "flaged" should read - - flage - -.
At column 10, line 47 (claim 16, line 2), "herbivores" should read - - herbivorous - -.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,127,022 
DATED : October 3, 2000
INVENTOR(S) : Zagarias Hendrik and Johannes Pretorius It is certified that error appears in the above-identified patent and that said Letters Patent is hereby corrected as shown below:

Column 8,
Line 37, “if” should read -- of --.
Line 43, “regions” should be deleted.

Column 9,
Line 46, “regions” should be deleted.
Line 47, “areas” should read -- curves --.

Column 10,
Line 9, “said” should read -- a --.
Line 29, “flaged” should read -- flage --.
Line 47, “herbivores” should read -- herbivorous --.

Signed and Sealed this

Fifth Day of October, 2004

JON W. DUDAS
*Director of the United States Patent and Trademark Office*